US010547128B1

(12) United States Patent
Lin et al.

(10) Patent No.: US 10,547,128 B1
(45) Date of Patent: Jan. 28, 2020

(54) EYE OF NEEDLE PRESS-FIT PIN WITH STRESS RELIEF

(71) Applicant: CISCO TECHNOLOGY, INC., San Jose, CA (US)

(72) Inventors: Qirong Lin, Shanghai (CN); George Edward Curtis, San Jose, CA (US); Ki-Yuen Chau, Palo Alto, CA (US); Quan Lu, Shanghai (CN); Xiaogang Li, Shanghai (CN)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 16/105,606

(22) Filed: Aug. 20, 2018

(51) Int. Cl.
*H01R 12/58* (2011.01)

(52) U.S. Cl.
CPC ..... *H01R 12/58* (2013.01)

(58) Field of Classification Search
CPC ..... H01R 12/58; H01R 12/00; H01R 12/52; H01R 12/585; H01R 12/718
USPC ..... 439/825, 78, 81, 82, 84
See application file for complete search history.

(56) References Cited

U.S. PATENT DOCUMENTS 4,691,979 A 9/1987 Manska
4,923,414 A * 5/1990 Sitzler ..... H01R 12/585 439/751
5,564,954 A * 10/1996 Wurster ..... H01R 12/585 439/751
6,565,392 B2 * 5/2003 Padro ..... H01R 13/428 439/751
7,780,483 B1 * 8/2010 Ravlich ..... H01R 12/585 439/751
8,002,559 B2 * 8/2011 Thiel ..... H01R 12/585 439/751
8,419,484 B2 * 4/2013 Kawai ..... H01R 12/585 439/733.1
8,771,028 B2 * 7/2014 Tonosaki ..... H01R 13/03 439/151
8,992,235 B2 * 3/2015 Kataoka ..... H01R 12/585 439/751
9,472,876 B1 10/2016 Hoffmeyer
10,096,917 B1 * 10/2018 Myer ..... H01R 12/585
2014/0099839 A1 6/2014 Trout
2014/0213080 A1 * 7/2014 Miyake ..... H01R 12/585 439/82

FOREIGN PATENT DOCUMENTS

KR 101158489 B1 7/2012

* cited by examiner

*Primary Examiner* — Travis S Chambers
(74) *Attorney, Agent, or Firm* — Cindy Kaplan

(57) ABSTRACT

In one embodiment, an eye of needle (EON) press-fit pin includes a base, a tip, and a compliant portion extending longitudinally between the base and the tip and comprising a pair of resilient deformable arms joined at opposite ends and defining an opening therebetween. The arms each include an outer surface for at least partial engagement with walls of an electrical via upon insertion therein. The outer surface of each of the arms includes a central segment having a flat longitudinal surface and converges from the central segment towards the base and the tip. The arms each further include an inner surface defining the opening and forming an elongated portion at each end of the opening for stress relief.

20 Claims, 4 Drawing Sheets

| | Via Diameter (0.0142" +/- 0.002) | | |
|---|---|---|---|
| | Nominal Diameter | Maximum Diameter | Minimum Diameter |
| Average Insertion Force (lbf) | 1.87 | 0.74 | 2.09 |
| Average Withdrawal Force (lbf) | 1.19 | 0.58 | 1.55 |

FIGURE 4

EYE OF NEEDLE PRESS-FIT PIN WITH STRESS RELIEF

TECHNICAL FIELD

The present disclosure relates generally to electronic components, and more specifically, to electronic connectors.

BACKGROUND

Various types of connections may be used to connect circuit components to a circuit board. One type of connection is a press-fit connection made through the pressing of a press-fit pin into a circuit board through a hole in the circuit board. The press-fit pin is designed to be inserted into a plated through hole in the circuit board and provide an electro-mechanical connection. Press-fit pins provide faster assembly and are more cost effective as compared to soldering.

BRIEF DESCRIPTION OF THE FIGURES

FIG. 4 is a table illustrating examples of insertion and withdrawal forces for a press-fit pin.

Corresponding reference characters indicate corresponding parts throughout the several views of the drawings.

DESCRIPTION OF EXAMPLE EMBODIMENTS

Overview

Figure 1:
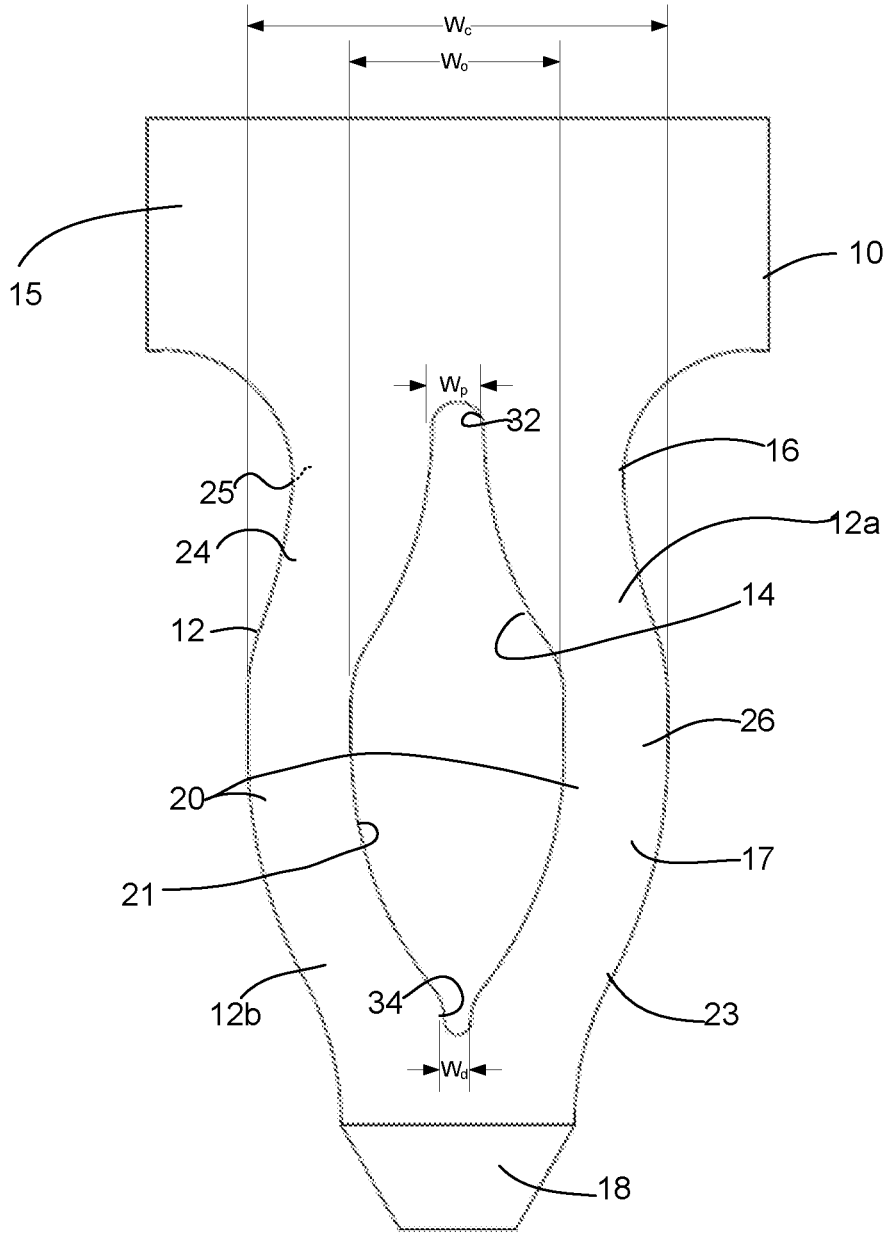
FIG. 1 is a front view of a press-fit pin, in accordance with one embodiment.

In one embodiment, an eye of needle (EON) press-fit pin generally comprises a base, a tip, and a compliant portion extending longitudinally between the base and the tip and comprising a pair of resilient deformable arms joined at opposite ends and defining an opening therebetween. The arms each comprise an outer surface for at least partial engagement with walls of an electrical via upon insertion therein. The outer surface of each of the arms comprises a central segment having a flat longitudinal surface and converges from the central segment towards the base and the tip. The arms each further comprise an inner surface defining the opening and forming an elongated portion at each end of the opening for stress relief.

In another embodiment, an apparatus generally comprises an electrical connector for insertion into an electrical via of a circuit board, the electrical connector comprising a pair of resilient arms joined at a proximal end and a distal end, the arms spaced from one another to define an opening therebetween. The opening comprises a central portion in which the arms are spaced from one another and extend generally parallel to one another, an upper portion in which the arms converge towards the proximal end, and a lower portion in which the arms converge towards the distal end. The opening is shaped to form a stress relief area at the proximal and distal ends.

In yet another embodiment, a press-fit pin generally comprises a tip for insertion of the press-fit pin into an electrical via, a compliant portion comprising a pair of resilient arms configured to deform when inserted into the electrical via, a crossbar extending horizontally between the arms, and a neck connecting the compliant portion to a base. The arms are spaced from one another to define an opening. The opening comprises a central portion, an upper portion, and a lower portion. The arms converge from the central portion towards an upper end and a lower end. Each of the upper end and the lower end of the opening comprises an elongated portion defining a stress relief area.

Further understanding of the features and advantages of the embodiments described herein may be realized by reference to the remaining portions of the specification and the attached drawings.

Example Embodiments

The following description is presented to enable one of ordinary skill in the art to make and use the embodiments. Descriptions of specific embodiments and applications are provided only as examples, and various modifications will be readily apparent to those skilled in the art. The general principles described herein may be applied to other applications without departing from the scope of the embodiments. Thus, the embodiments are not to be limited to those shown, but are to be accorded the widest scope consistent with the principles and features described herein. For purpose of clarity, details relating to technical material that is known in the technical fields related to the embodiments have not been described in detail.

Circuit boards typically include electrical vias that receive press-fit pins for electronically connecting the circuit board to another electrical device (e.g., component, electrical connector, another circuit board, cable, power source). An electrical connection in the circuit board may be made through the pressing of a press-fit pin into the circuit board through the via in the circuit board. The cross-sectional diameter of the press-fit pin is greater than a diameter of the circuit board via. The difference between the press-fit pin cross-sectional diameter and the circuit board via diameter results in deformation of an internal wall of the circuit board via, the press-fit pin, or both during the process of inserting the press-fit pin into the circuit board via. This deformation creates a snug electrical connection between the press-fit pin and the circuit board.

Many press-fit pins are designed with an eye of needle (EON) in the form of a needle eye with arms that surround the EON forming a continuous concave curve. A major advantage of the EON design is that it is possible to scale down the size of the press-fit pin and it is relatively easy to manufacture (e.g., using a stamping process) as compared to more complex designs. However, conventional EON press-fit pin designs have a number of drawbacks. For example, conventional EON geometries often result in an uneven force distribution over the length of the press-fit pin when the pin is inserted into the circuit board via and the arms are deformed. Also, if the circuit board has a large tolerance of a plated through hole (PTH), conventional press-fit pins may not provide sufficient retention forces.

Plated through hole diameters have dropped dramatically overtime from 0.040 inches down to 0.032 inches, 0.022 inches, 0.018 inches, and now as low as 0.016 and 0.012 inches, as a result of higher pin density and the signal integrity advantages of smaller holes. Additional issues arise with conventional EON press-fit pins as pin sizes are further reduced, which makes the design of a robust press-fit pin for a smaller finished hole more difficult. For example, the tolerance percentage of the plated through hole increases with smaller holes, making it more difficult to provide an electrical connector with a low insertion force and high retention force. With smaller diameter holes, additional failure modes such as buckling deformation, poor engagement force, or even dislodgement of the connector from the circuit may occur more often.

The embodiments described herein provide a compliant press-fit pin that will deform during insertion into a plated through hole and sustain a permanent contact normal force to secure electrical and mechanical connections with a geometry that provides increased retention force, reduced insertion force, and compensates for a large tolerance plated through hole to ensure low contact resistance with small deformation of the plated through hole.

Referring now to the drawings, and first to FIG. 1, an example of a press-fit pin 10 is shown, in accordance with one embodiment. The press-fit pin 10 may be connected to a housing (not shown) at its base 15 along with a plurality of press-fit pins. As described in detail below, the geometry of the press-fit pin 10 optimizes a trade-off between the retention force and the insertion force and addresses issues that have arisen from a large tolerance limit of a plated through hole (PTH) in PCBs (printed circuit boards), especially with small diameter holes (electrical vias).

As shown in the front view in FIG. 1, the press-fit pin 10 comprises a conductive body 12 shaped generally as an eye of needle (EON) defining an opening 14 that is configured to compress when the pin is inserted into a through hole or via of a substrate (circuit board), as described below with respect to FIG. 2. The body 12 extends along a central longitudinal axis outwardly from the base (head) 15 and includes a neck portion (neck) 16, a compliant portion 17, and a tip portion (tip) 18. As previously noted, the base 15 may be connected to a housing comprising a plurality of press-fit pins or each pin may be individually inserted into a via. The base 15 may be any shape and preferably has a width larger than the via to prevent insertion of the base into the via. The compliant portion 17 is joined to the base 15 at the neck 16 and extends from the neck to the tip portion 18. The tip 18 is configured to be received in the electrical via before the compliant portion 17 is received in the electrical via, as described below with respect to FIG. 2. In one or more embodiments, the tip 18 is beveled inwardly and includes a flat bottom as shown in FIG. 1. The width of the tip 18 is smaller than the width of the compliant portion 17 for ease of insertion into the via.

The opening 14 extends longitudinally within the conductive body 12 of the press-fit pin 10 from the neck 16 to an upper end of the tip portion 18. The opening 14 is defined by a pair of resiliently deformable arms 20 that are connected at their proximal end (near base 15) and distal end (near tip 18) and are spaced apart to define the opening 14 therebetween. The compliant portion 17 of the body 12 is configured to be compressed as it is received in the electrical via such that inner surfaces (edges) 21 of the arms 20 are moved inward toward one another, thereby reducing the EON (opening) 14. Outer contact surfaces (edges) 23 of the arms 20 contact the plated wall of the electrical via, at least partially engaging an interior wall of the via as described below with respect to FIG. 2. The inner surfaces 21 and outer surfaces 23 of the arms 20 extend transversely between a front surface 24 and a rear surface 25 of the pin 10. The press-fit pin may have a thickness of between 0.002 and 0.004 inch, for example, thus, the inner and outer surfaces 21, 23 may be referred to as edges. The press-fit pin 10 may be formed from a copper alloy or other suitable conductive material.

As described in detail below, stress relief areas 32, 34 may be formed in upper (proximal) and lower (distal) ends of the opening 14, respectively, to maintain as much elastic region as possible, compensate for extra deformation that may be present during insertion of the press-fit pin into the via due to a lower tolerance limit, and provide sufficient retention force for an upper tolerance limit. In one or more embodiments, a central segment (central portion) 26 of the compliant portion 17 (inner surface 21, outer surface 23, or both surfaces of the arms 20) may include a longitudinally extending flat surface to enhance retention force. Thus, at least a small longitudinal section (e.g., 0.002 inch) of each arm 20 may extend generally parallel to the other arm at the central segment 26. For smaller diameter press-fit pins the length of this longitudinally extending flat section may be even smaller.

Figure 2:
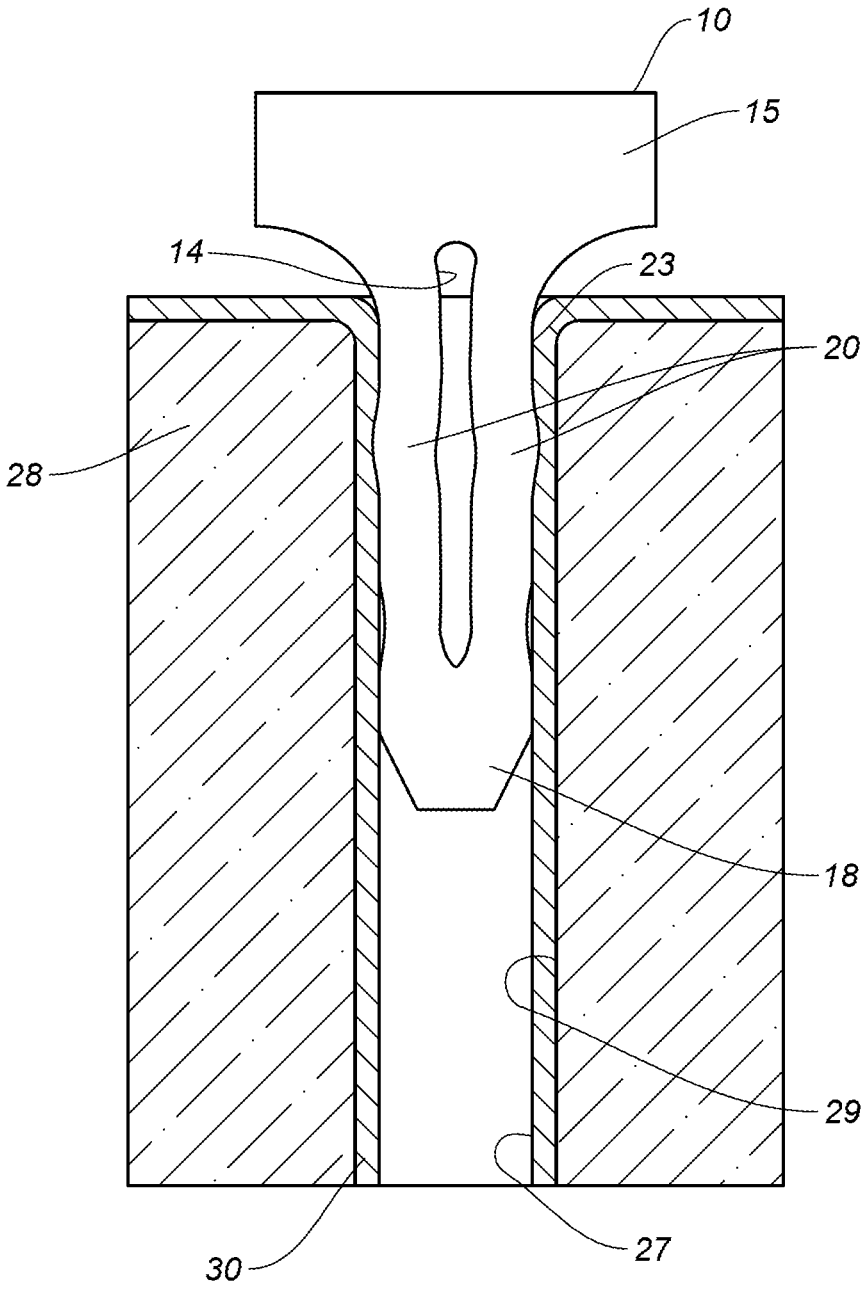
FIG. 2 is a cross-sectional view showing the press-fit pin of FIG. 1 inserted into an electrical via of a circuit board.

FIG. 2 illustrates the press-fit pin 10 of FIG. 1 inserted into an electrical via (bore, opening, hole, plated through hole) 27 in a substrate (e.g., printed circuit board) 28. The circuit board includes any number of electrical vias 27, which extend into the substrate, for receiving any number of press-fit pins 10. The electrical vias 27 are defined by openings within the substrate 28 that have interior walls 29 that have an electrically conductive material (plated layer 30) thereon, such that the electrical vias are electrically conductive. The electrical vias 27 may be electrically connected to electrical circuits of the circuit board or electrical components through the electrical connector (press-fit pin) 10. Each electrical via 27 may extend completely through the substrate 28 or may extend only partially therethrough.

As the press-fit pin 10 is inserted into the electrical via 27, outer surfaces 23 of the resilient arms 20 at least partially engage the electrically conductive material 30 on the interior wall of the electrical via and the arms are deflected inwardly toward one another. As described below, the geometry of the press-fit pin 10 is configured such that the deformed pin will be in full (or substantially full) contact with the plated hole 27 after insertion. The deflection of the arms 20 causes the arms to exert spring forces against the electrically conductive material 30. Engagement between the arms 20 and the electrically conductive material 30 of the via 27 electrically connects the press-fit pin 10 and the via. The spring forces exerted by the arms 20 provide a retention force. The difference between the press-fit pin's diameter and diameter of the via 27 results in deformation of the press-fit pin 10 and the conductive layer 30 of the via, which creates a snug electrical connection between the press-fit pin and interior wall of the via. Tuning of the profile geometry of the press-fit pin 10 allows for a greater portion (e.g., most or substantially all) of the outer surface 23 of the arms 20 to be in full contact with the plated through hole after insertion of the press-fit pin into the via 27, as described below. After the arms 20 are deformed upon insertion of the press-fit pin 10 into the via 27, the opening 14 is compressed creating a narrower and generally uniform slot, as shown in FIG. 2.

Referring again to FIG. 1, in one or more embodiments, stress relief is added by extending the opening 14 at each end in two narrow elongated portions 32, 34 on the proximal (upper) end and distal (lower) end of the opening (EON). The stress relief area 32 on the upper end of the opening 14 compensates for the large tolerance limit of the plated through hole (PTH) 27 and controls the deformed shape of the upper portion 12*a* of the body 12 (FIGS. 1 and 2). The stress relief area 34 on the lower end of the opening 14 lowers the insertion force and controls the deformed shape of the lower portion 12*b* of the body 12.

Figure 3A:
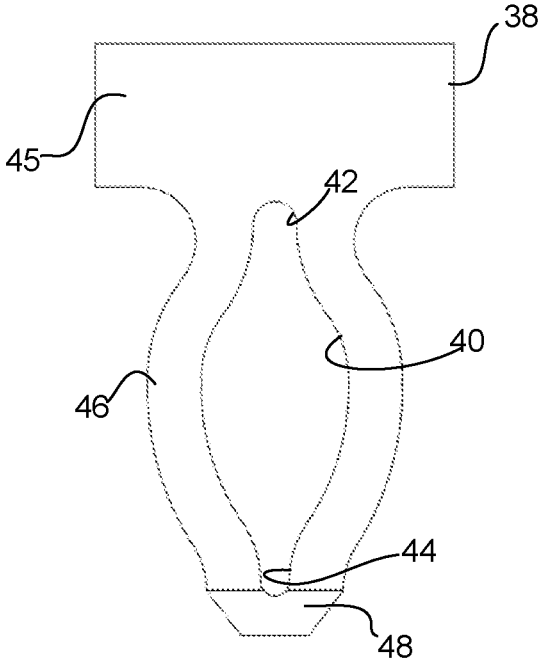
FIG. 3A is a front view of a press-fit pin for use in a smaller diameter hole.

The geometry shown in FIG. 1 may be used, for example, for a 0.0122 inch finished hole. Modifications may be made to the geometry as shown in FIG. 3A for a press-fit pin 38 that may be used for a 0.0102 inch finished hole and in FIG. 3B for a press-fit pin 39 that may be used in an 0.0082 inch finished hole, for example. It is to be understood that these are only examples, and variations in geometry may be made for use in different size vias. Each of the geometries includes a stress relief elongated portion 32, 34, 42, 44, 52, 54 at each end of the opening 14, 40, 50 and a central flat segment 26, 46, 56 within the compliant portion.

As previously noted, the press-fit pin geometry is designed to maintain as much elastic region as possible and compensate for the extra deformation due to the lower tolerance limit of the finished hole while providing sufficient retention force for the upper tolerance limit. The convergent design optimizes the trade-off between the retention force and the insertion force and addresses the issues that arise from the large tolerance limit of the plated through hole of the electrical via in the printed circuit board.

Rather than forming a continuous oval, each end of the opening 14 extends into a longitudinal narrow slot 32, 34 (FIG. 1). As shown in FIG. 1, the stress relief areas 32, 34 on the upper (proximal) and lower (distal) ends are defined by elongated portions (slots, slits, narrow openings, cutouts, parallel inner surface segments) that extend from the converging inner surfaces 21 of the arms 20. The elongated portions 32, 34 at each end of the opening 14 form a narrow slit and may be defined, for example, as a "bowling pin" shaped tip at each end (FIG. 1). In conventional EON pins, the opening typically forms a continuous oval shape in its non-deformed condition prior to insertion in the via. As shown in the examples of FIGS. 1, 3A, and 3B, as the opening 14, 40, 50 converges away from the central segment 26, 46, 56 towards the proximal and distal ends, the inner surfaces 21 may begin to form a generally convex shape leading into the elongated portions 32, 34 (FIG. 1), 42, 44 (FIG. 3A), 52, 54 (FIG. 3B) at each end of the opening 14, 40, 50.

Figure 3B:
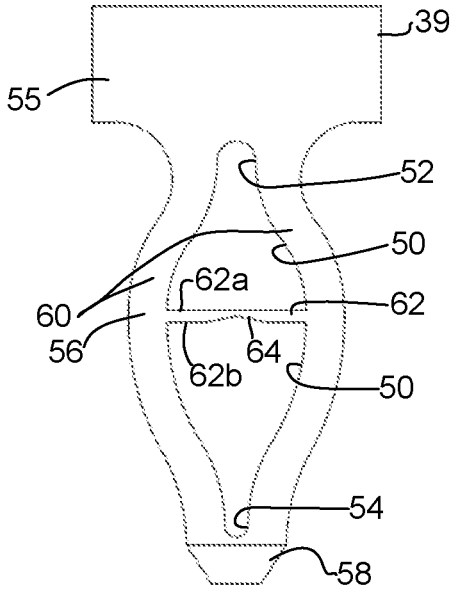
FIG. 3B is a front view of a press-fit pin for use in an even smaller diameter hole.

The elongated portions are defined by generally parallel inner surfaces 21 of the arms 20 that lead to partial circle or semi-circle transverse openings (as viewed from the front of the pin as shown in FIGS. 1, 3A, and 3B). In one or more embodiments, the semi-circle at the proximal (upper) end has a radius larger than the semi-circle at the distal (lower) end of the opening (e.g., radius of the opening at distal end may be between 50% and 70% of the radius of the opening at the proximal end). The width ($W_p$) of the elongated portion at the proximal end may be, for example, between 20% and 30% of the widest portion of the opening 14, 40, 50 at its central segment ($W_o$). The width ($W_d$) of the elongated portion at the distal end may be, for example, between 13% and 20% of the width ($W_o$) of the opening at its central segment.

The elongated portion 32, 42, 52 at the proximal end extends into the neck portion of the press-fit pin and terminates before reaching the base 15, 45, 55 (FIGS. 1, 3A, 3B). The elongated portion 34, 44, 54 at the distal end may terminate before reaching the beveled portion of the tip 18 (FIG. 1), 58 (FIG. 3B), or extend into the beveled portion of the tip 48 (FIG. 3A). The longitudinal length of each of the elongated portions may be, for example, between 4% and 10% of the length of the opening 14, 40, 50.

As previously noted, in addition to the stress relief at each end of the opening 14, 40, 50, the central segment 26, 46, 56 of the arms may comprise a longitudinal flat surface to enhance the retention force of the inserted press-fit pin 10, 38, 39, in one or more embodiments. The flat surface is generally located at a segment where an apex of an oval opening would be located and may extend, for example, over an area from between 5% and 10% of the longitudinal length of the opening 14, 40, 50. In one example, both the inner surface 21 and outer surface 23 of the arms 20 of the central segment are formed with a flat surface (FIG. 1). Thus, at the location of the flat surface in the central segment 26, the arms 20 extend generally parallel to one another as well as the inner surfaces 21 and outer surfaces 23.

The following provides examples of overall dimensions of the press-fit pin shown in FIG. 1. It is to be understood that these are only examples and that other dimensions may be used, without departing from the scope of the embodiments. As previously noted, the press-fit pin shown in FIG. 1 may be used, for example, for insertion into a finished hole with a diameter of 0.0122 inch. The width ($W_c$) of the pin 10 at the widest section of the compliant portion 17 (located at the flat section of the central segment 26) may be, for example, 0.0162 inch and the width ($W_o$) of the opening 14 at a corresponding location may be, for example, 0.0082 inch, resulting in a thickness of the arms 20 of 0.004 inch at the central segment 26 (FIG. 1). The width ($W_p$) of the elongated portion 32 at the proximal end of the opening 14 may be, for example, 0.002 inch and the width ($W_d$) of the elongated portion 34 at the distal end of the opening may be, for example, 0.001 inch. The stress relief areas 32, 34 may have a length of about 0.002 inch and 0.001 inch, respectively. The longitudinal length of the opening 14 may be, for example, 0.0245 inch, and the overall length of the press-fit pin (including the base) may be, for example, 0.043 inch. In the example shown in FIG. 1, the press-fit pin 10 may have a thickness of 0.004 inch.

In one or more embodiments, the press-fit pin may include a crossbar 62 extending between arms 60 as shown in FIG. 3B. The crossbar 62 reduces the risk of buckling with smaller diameter pins (e.g., for use in a 0.0082 inch finished hole). As shown in FIG. 3B, the crossbar 62 may extend between opposing arms 60, generally perpendicular to the flat surface of central segment 56 of the press-fit pin 39. In one example, the crossbar 62 has a thickness of 0.0006 inch. The crossbar 62 may extend generally horizontally between the arms 60. In the example shown in FIG. 3B, an upper surface 62*a* of the crossbar 62 is generally flat and a lower surface 62*b* has a notch 64 (e.g., v-shaped) formed therein extending upwardly from a lower surface (distal side) of the crossbar.

In one or more of the embodiments, the total length of the press-fit pin decreases gradually as the diameter of the pin decreases (for use in smaller diameter vias) to improve the signal integrity performance. However, this may also increase the insertion force while reducing the length of the pin. Therefore, there is a trade-off between the insertion force and the signal integrity performance. The crossbar 62 (FIG. 3B) may be used to reduce the length of the pin and reduce the risk of buckling due to the insertion force.

FIG. 4 is a table illustrating an example of insertion and withdrawal (retention) forces for a press-fit pin based on a mechanical insertion and pull test for a press-fit pin inserted into a via with a diameter of 0.0142 inch+/−0.002 and having a geometry as described herein. As shown in the table, the forces are highest when the via is at its low tolerance limit (minimum diameter of 0.0122 inch). It is to be understood that the insertion and withdrawal forces shown in the table of FIG. 4 are only examples.

The press-fit pin described herein may be used, for example, to provide electrical connections in a circuit board for use in a network device. The network device may comprise, for example, a programmable machine that may be implemented in hardware, software, or any combination thereof. The network device may include one or more processor, memory, and network interfaces. Memory may be a volatile memory or non-volatile storage, which stores various applications, operating systems, modules, and data for execution and use by the processor. The network interfaces may comprise any number of interfaces (e.g., line cards, ports) for receiving data or transmitting data to other devices.

In one or more embodiments, the network device operates in a data communications network including multiple network devices. The network device may comprise, for example, a router, switch, server, or other network device, which may communicate over one or more networks (e.g., local area network (LAN), metropolitan area network (MAN), wide area network (WAN), virtual private network (VPN) (e.g., Ethernet virtual private network (EVPN), layer 2 virtual private network (L2VPN)), virtual local area network (VLAN), wireless network, enterprise network, corporate network, data center, Internet, intranet, radio access network, public switched network, or any other network).

Although the apparatus has been described in accordance with the embodiments shown, one of ordinary skill in the art will readily recognize that there could be variations made without departing from the scope of the embodiments. Accordingly, it is intended that all matter contained in the above description and shown in the accompanying drawings shall be interpreted as illustrative and not in a limiting sense.

What is claimed is:

1. An eye of needle (EON) press-fit pin comprising:

a base;

a tip; and a compliant portion extending longitudinally between the base and the tip and comprising a pair of resilient deformable arms joined at opposite ends and defining an opening therebetween, the arms comprising a central portion in which the arms are spaced from one another and extend generally parallel to one another to enhance retention force, each of the arms comprising an outer surface for at least partial engagement with walls of an electrical via upon insertion therein, said outer surface of each of the arms comprising a central segment having a flat longitudinal surface and converging from said central segment towards the base and the tip, and an inner surface defining said opening, said inner surface converging in a generally convex shape into a semi-circle defined by an elongated portion at each end of the opening for stress relief;

wherein the semi-circle at a proximal end of said opening near the base has a radius larger than the semi-circle at a distal end of said opening near the tip and wherein said elongated portion at said proximal end of said opening is configured to compensate for a large tolerance limit of the electrical via and wherein said elongated portion at said distal end of said opening is configured to reduce an insertion force of the EON press-fit pin into the electrical via.

2. The EON press-fit pin of claim 1 wherein the opening extends from a neck of the press-fit pin to a location adjacent to the tip.

3. The EON press-fit pin of claim 1 wherein a width of said elongated portion at said proximal end of said opening near the base is larger than a width of said elongated portion at said distal end of said opening near the tip.

4. The EON press-fit pin of claim 1 wherein a width of said elongated portion is thirty percent or less than a width of said opening at said central segment.

5. The EON press-fit pin of claim 1 wherein the arms are deformed upon insertion of the EON press-fit pin into the electrical via and said opening forms a slot having a generally uniform width.

6. The EON press-fit pin of claim 1 wherein said inner surface of the arms are generally parallel to one another in said elongated portion.

7. The EON press-fit pin of claim 1 wherein the tip is beveled inwardly and includes a flat bottom, said opening extending into or adjacent to the beveled tip.

8. The EON press-fit pin of claim 1 wherein the radius of the opening at distal end is between 50% and 70% of the radius of the opening at the proximal end.

9. The EON press-fit pin of claim 1 further comprising a crossbar extending between the arms.

10. The EON press-fit pin of claim 9 wherein the crossbar extends generally horizontally between the arms and wherein only one edge of the crossbar comprises a notch formed therein.

11. An apparatus comprising:

an electrical connector for insertion into an electrical via of a circuit board, the electrical connector comprising a pair of resilient arms joined at a proximal end and a distal end, the arms spaced from one another to define an opening therebetween;

wherein said opening comprises a central portion in which the arms are spaced from one another and extend generally parallel to one another to enhance retention force, an upper portion in which the arms converge towards said proximal end, and a lower portion in which the arms converge towards said distal end;

wherein said opening is shaped to form a stress relief area at said proximal end and said distal end; and wherein an inner surface of the arms defining said opening converges in a generally convex shape into a semi-circle, the semi-circle at said proximal end of said opening comprising a radius larger than the semi-circle at said distal end of said opening and wherein the semi-circle at said proximal end of said opening is configured to compensate for a large tolerance limit of the electrical via and wherein the semi-circle at said distal end of said opening is configured to reduce an insertion force of the apparatus into the electrical via.

12. The apparatus of claim 11 further comprising a generally horizontal crossbar extending between the arms.

13. The apparatus of claim 11 wherein a width of said opening at said proximal end is larger than a width of said opening at said distal end, said distal end located adjacent to a tip of the electrical connector.

14. The apparatus of claim 11 wherein the arms are deformed upon insertion of the electrical connector into the electrical via and said opening forms a slot having a generally uniform width.

15. The apparatus of claim 11 wherein said stress relief areas are shaped to control deformation of the arms.

16. The apparatus of claim 11 wherein said central portion covers ten percent or less of a longitudinal length of said opening.

17. A press-fit pin comprising:

a tip for insertion of the press-fit pin into an electrical via;

a compliant portion comprising a pair of resilient arms configured to deform when inserted into the electrical via;

a crossbar extending horizontally between the arms to reduce a risk of buckling; and a neck connecting the compliant portion to a base;

wherein the arms are spaced from one another to define an opening, said opening comprising a central portion, an upper portion, and a lower portion, the arms converging from said central portion towards an upper end near the base and a lower end near the tip, each of said upper end and said lower end of said opening comprising an elongated portion defining a stress relief area;

wherein said elongated portion comprises a semi-circle and wherein the semi-circle at said upper end has a radius larger than the semi-circle at said lower end and wherein the semi-circle at said upper end is configured to compensate for a large tolerance limit of the electrical via and wherein the semi-circle at said lower end is configured to reduce an insertion force of the press-fit pin into the electrical via.

18. The press-fit pin of claim 17 wherein the arms extend generally parallel to one another in said central portion to enhance retention force.

19. The press-fit pin of claim 17 wherein the crossbar comprises an upper flat edge and a lower edge with a notch formed therein.

20. The press-fit pin of claim 17 wherein the arms are deformed upon insertion of the press-fit pin into the electrical via and said opening forms a slot having a generally uniform width.

* * * * *